US008375477B2

(12) United States Patent
Johnson

(10) Patent No.: US 8,375,477 B2
(45) Date of Patent: Feb. 19, 2013

(54) WATER FEATURE FOR WAVE POOLS

(76) Inventor: Garrett Tyler Johnson, Virginia Beach, VA (US)

( * ) Notice: Subject to any disclaimer, the term of this patent is extended or adjusted under 35 U.S.C. 154(b) by 538 days.

(21) Appl. No.: 12/586,593

(22) Filed: Sep. 24, 2009

(65) Prior Publication Data

US 2010/0011497 A1 Jan. 21, 2010

Related U.S. Application Data

(63) Continuation-in-part of application No. 12/286,632, filed on Oct. 1, 2008, now abandoned, which is a continuation-in-part of application No. 11/786,652, filed on Apr. 12, 2007, now abandoned, which is a continuation-in-part of application No. 11/732,233, filed on Apr. 3, 2007, now Pat. No. 7,438,080, application No. 12/586,593, which is a continuation-in-part of application No. 11/433,035, filed on May 12, 2006, now abandoned.

(60) Provisional application No. 60/680,365, filed on May 12, 2005, provisional application No. 60/878,784, filed on Jan. 6, 2007, provisional application No. 60/789,000, filed on Apr. 4, 2006.

(51) Int. Cl.
*A47K 3/10* (2006.01)

(52) U.S. Cl. ..... 4/491

(58) Field of Classification Search ..... 4/491; 405/79
See application file for complete search history.

(56) References Cited

U.S. PATENT DOCUMENTS

| | | | |
|---|---|---|---|
| 2,056,855 | A | 10/1936 | Hertz |
| 4,515,500 | A | 5/1985 | Bastenhof |
| 4,522,535 | A | 6/1985 | Bastenhof |
| 4,720,210 | A | 1/1988 | Stoner et al. |
| 4,805,896 | A | 2/1989 | Moody |
| 4,812,077 | A | 3/1989 | Ralke |
| 5,186,578 | A | 2/1993 | Perslow |
| 5,226,747 | A | 7/1993 | Wang et al. |
| 5,282,487 | A | 2/1994 | Timpany |
| 5,364,208 | A | 11/1994 | Taguchi |
| 5,421,782 | A | 6/1995 | Lochtefeld |
| 5,507,601 | A | 4/1996 | Taguchi |
| 5,544,983 | A | 8/1996 | Taguchi |
| 5,611,671 | A | 3/1997 | Tripp, Jr. |
| 5,738,590 | A | 4/1998 | Lochtefeld |
| 5,766,082 | A | 6/1998 | Lochtefeld |
| 5,833,393 | A | 11/1998 | Carnahan et al. |
| 6,224,342 | B1 | 5/2001 | Russell et al. |
| 6,640,470 | B2 | 11/2003 | Chesner et al. |
| 6,857,967 | B2 | 2/2005 | Loyd et al. |
| 6,912,738 | B2 | 7/2005 | Black |
| 2004/0261858 | A1 | 12/2004 | Ferrel |
| 2006/0022470 | A1 | 2/2006 | Johnson |

OTHER PUBLICATIONS

Typhoon Lagoon Surf Pool Map dated Jun. 21, 2003; http://web.archive.org/web/20030621222626/http://www.disneyclubs.com/dw_maps/typhoon_map.jpg.

*Primary Examiner* — Lori Baker
(74) *Attorney, Agent, or Firm* — Williams Mullen

(57) ABSTRACT

The present invention relates to wave pools and diversion channels that capture high kinetic energy portions of a wave generated within the wave pool, and redirects the captured wave portions to the vicinity of wave formation, preferably timed so as reinforce a subsequently generated wave. The high kinetic energy within the diversion channel creates an additional feature in the form of an action river for riders of a wave pool to enjoy. At the same time, capturing of portions of the wave reduces the backwash of the wave and stabilizes the level of water within the wave pool, especially for embodiments with wave generators and pools capable of high volume waves. Riders may enter the diversion channel and ride from the distal, beach end of the wave pool to the proximal, wave generating end.

18 Claims, 11 Drawing Sheets

WATER FEATURE FOR WAVE POOLS

CROSS REFERENCE TO RELATED APPLICATIONS

This application is a continuation-in-part of U.S. patent application Ser. No. 11/433,035, filed May 12, 2006 now abandoned, which claimed the benefit of priority from U.S. Provisional Application Ser. No. 60/680,365, filed May 12, 2005, both of which are hereby incorporated by reference in their entireties. This application is also a continuation-in-part of U.S. patent application Ser. No. 12/286,632, filed Oct. 1, 2008 now abandoned, which is (i) a continuation-in-part of U.S. application Ser. No. 11/786,652, filed Apr. 12, 2007 now abandoned, which claimed the benefit of priority from U.S. Provisional App. 60/878,784, filed Jan. 6, 2007, and U.S. Provisional Application 60/789,000, filed Apr. 4, 2006, and (ii) a continuation-in-part of U.S. patent application Ser. No. 11/732,233, filed Apr. 3, 2007, now issued as U.S. Pat. No. 7,438,080, which claimed the benefit of priority from U.S. Provisional App. 60/789,000 filed Apr. 4, 2006, all of which are hereby incorporated by reference in their entireties.

FIELD OF THE INVENTION

The present invention relates to water rides or activities. More particularly, the present invention is a recreational water feature integrated into a pool having artificially generated waves and/or swells.

BACKGROUND OF THE INVENTION

Millions of individuals visit water parks every year to enjoy, among other attractions, various types of swimming pools. In particular, wave pools are generally known in the field as providing recreation involving artificially generated waves. The waves are traditionally formed by devices such as oscillating pressure caissons, periodic displacement devices, or devices for release of large volumes of water into the pool.

A new form of wave generation technology was disclosed in U.S. Pat. No. 5,833,393 to Carnahan et al., which is hereby incorporated by reference in its entirety. This technology is sometimes referred to as a wave cannon. A wave cannon transfers energy from the discharge of compressed air through a water-filled pipe and into a body of water to create swells or waves. Because of the nature of compressed gas, wave cannons may transfer large amounts of energy while providing unobtrusive infrastructure. This large amount of energy transfer improves the ability to produce larger waves.

In contrast, conventional wave generating technologies have been somewhat limited in the energy that can be imparted to the pool, based on the practical limits of size, mechanics, infrastructure, and cost. Thus, most wave pools are limited in size, with the larger wave pools being in the form of oversized swimming pools. Even with a smaller size, some wave pools incorporate special hydrodynamic features, such as narrowing waterways or wedge designs, to preserve or increase the wave height of these lower capacity waves.

The wave cannon may be scaled by size, number, orientation, and co-location. The wave cannon structure may be recessed, with structure located away from the body of water where an activity or water sport occurs. The structure of the wave generating device is thus removed from the area of activity and will not impair water sports. The small circular opening in the tubular chamber of a wave cannon permits novel orientations that enhance the production of large scale wave action similar to that in natural ocean environments. For example, a cluster of wave cannons at one end of a wave pool may generate waves sufficiently large for surfing.

A problem present in all conventional wave pools is the backwash caused by breaking waves. With smaller scale wave pools, this backwash has not been much of an issue. Simulated beaches or extensive shallows may be sufficient for smaller capacity breaking waves. However, the backwash of larger capacity waves may pose greater difficulties. The backwash of larger capacity waves may have the ability to draw individuals, floats, or surfboards into the paths of others located within the pool. The approach of a large capacity wave may then pose a safety hazard due to flotsam or individuals in the path of surfers or other individuals riding the wave.

Some conventional attempts to address the problems of this backwash have involved "lazy rivers" or water channels installed adjacent to the wave pool, and in which the intake and discharge of the lazy river is in fluid communication with the wave pool. Because a flow of water is desired from the wave breaking end of the pool to the wave generating end, some current may be created within the lazy river. This current has been created in some embodiments by permitting the breaking waves from the main pool to spill over a spillway or weir into the lazy river channel. Such pools are characterized by minor bottom shaping with largely dissipative beaches. In other cases, a current will be created within the lazy river channel by the installation of dedicated pumps. Some embodiments orient the inlet of the lazy channel and the dissipative slope of the simulated beach end so as to direct backwash into the mouth of the lazy river. Once established, the current is thus intended to draw some volume of water from the end of the wave pool in which waves break to the end of the wave pool where waves are formed, hopefully reducing the water backwashed to the deeper section of the wave pool.

The perimeter lazy river can reduce some of the backwash created in conventional wave pools by diverting some of the water. Of course, much of its effectiveness depends on the volumetric flow created by spill over or the volumetric flow rate of the pumps. However, it is impractical for wave pools having the large volume waves that are capable of being produced by the wave cannon. A greater reduction the backwash is required. The installation of pumps dedicated to generating a current in the lazy river provides additional infrastructure and cost. In addition, the slow current of a lazy river is inconsistent with the highly active sport of surfing.

Thus, conventional approaches to the reduction of wave pool backwash are not well suited to high capacity wave pools.

BRIEF SUMMARY OF THE INVENTION

The present invention is directed to providing a means of reducing backflow caused by the breaking of high volume, generated waves within a wave pool. Further, the present invention provides high energy circulating currents for the benefit of swimmers and surfers.

Large, high volume waves may be generated using one or more wave cannons, or equivalent high volume technologies. Large, balanced return channels may be integrated within the pool, such that then currents formed therein are capable of accommodating the large volumetric flow. This integration permits wave pool features directing larger amounts of wave energy into the diversion or return channels. In addition to the attraction of the wave pool, the present invention integrates diversion channels that act as action river water attractions based on the captured wave energy. Riders may enter a diversion channel to travel from the wave breaking end to the wave generating end of a wave pool.

In one embodiment, an integrated diversion channel may be formed by islands situated within the wave pool that function in cooperation with a contoured bottom of the pool. The contoured bottom forms a reef that breaks the wave in a controlled manner within a reservoir bounded on one end with a dissipative beach. The contours forming the reservoir direct backflow water from the breaking waves into the diversion channel. The islands are configured such that the channels open to the generated wave, so that a significant, high energy portion of the wave is captured by the channel. The combined effect of the input of backflow water from the reservoir and the capture of high energy waves forms a beneficial, high flow, action river current along the channel. The current within this diversion channel feeds back into the wave generation process, stabilizing currents and reducing back flow or rip currents.

DETAILED DESCRIPTION OF THE INVENTION

As introduced above, the present invention provides a means of reducing backflow caused by the breaking of high volume, generated waves within a wave pool, while also providing strong circulating currents and waves supporting action river activities for swimmers and surfers.

Figure 1:
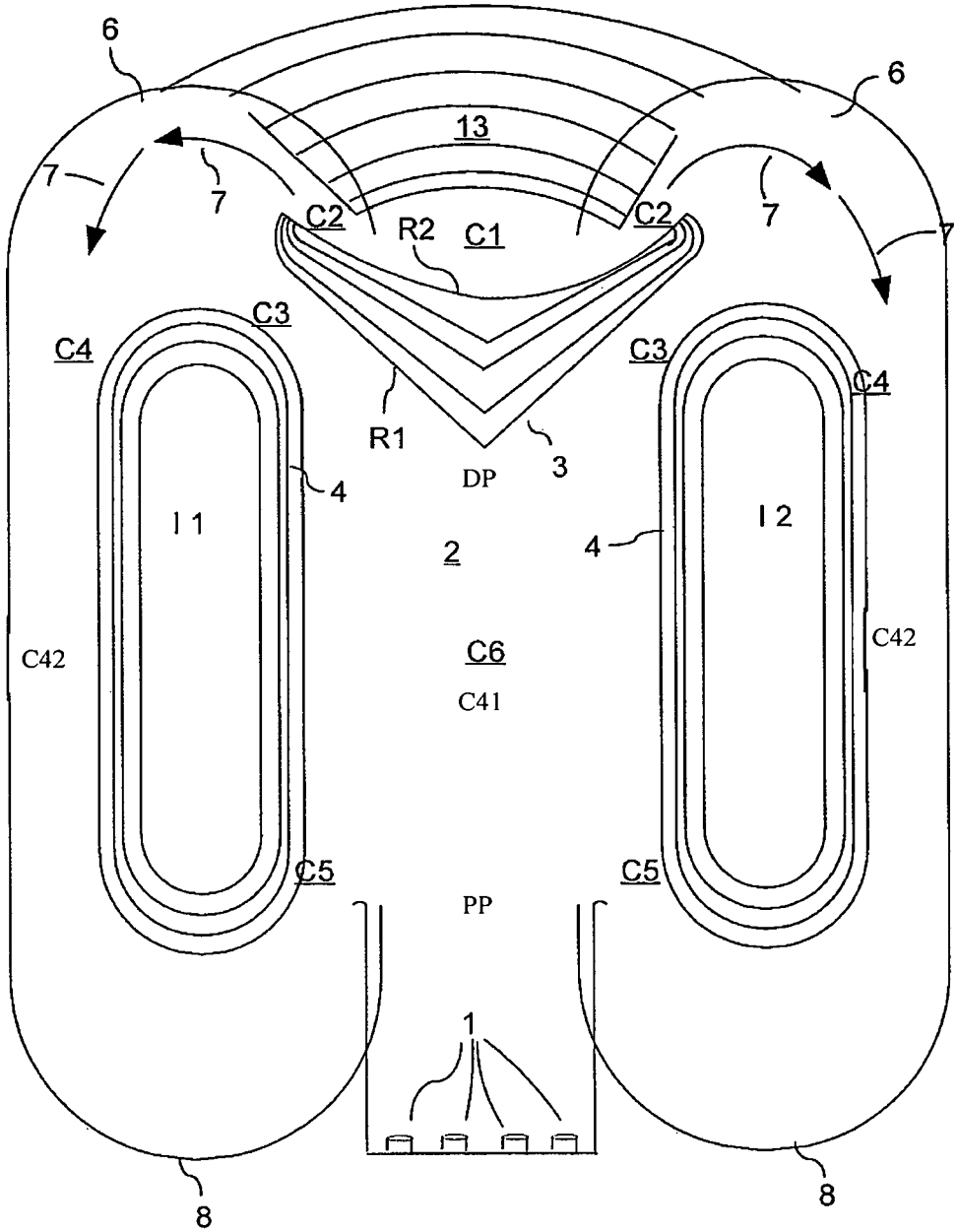
FIG. 1 is a top view of an embodiment of the present invention.

With reference to the drawings, a top view of an embodiment of the present invention may be seen in FIG. 1. Wave pool 2 has a bottom at desired depths and at least one vertical sidewall 8 adapted to contain the body of water, the body thus having a proximal portion PP and a distal portion DP. Wave pool 2 is adapted to contain a body of water. Wave generator 1 is connected to or disposed in wave pool 2 at a proximal portion PP of the body of water. The bottom and at least one vertical sidewall 8 form a substantially dissipative beach 13 (shown by isobaths) disposed at the distal portion DP of the body of water.

Optional reef contour 3 (also shown by isobaths) may be disposed at the distal portion DP of the body of water, configured for supporting the generation of high volume, high energy waves, such as generated wave 19 (not shown). Generated wave 19 may break in a controlled manner as it reaches reef contour 3, while moving from the proximal portion PP to the distal portion DP. Otherwise, they may break and/or dissipate on beach 13. In general, optional reef contour 3 may be disposed substantially laterally in the bottom intermediate the wave generator and a dissipative beach. Reef contour 3 may have a lateral V shape, with the vertex oriented generally toward the wave generator, which divides wave 19 and directs wave wash into the side channels C4.

Preferably, but not necessarily, wave pool generator 1 is one or more high volume wave cannons, which are described in further detail below. Reef contour 3 may thus be interposed intermediate between wave generator 1 and beach 13. As illustrated, reef contour 3 is disposed substantially laterally in the pool bottom, which is intended to indicate a disposition effective to produce a desired wave effect laterally across wave generating zone C6 within the body of water.

Integrated into the wave pool 2 are diversion channels C4 formed or defined by at least two islands I1 and I2, which are disposed in the bottom inward from the at least one pool side 8. Islands I1 and I2 are configured, along with the at least one pool side 8 to define diversion channels C4. Diversion channels C4 are open to oncoming waves so as to be able to capture a significant, high energy portion of such waves, using entry channels C3, which wave portion then flows into diversion channels C4. Input side walls 6 for diversion channels C4 are thus configured so as to redirect in a non-dissipative way at least a portion of a captured wave along diversion channels C4. The at least two islands I1 and I2 define the at least two integrated diversion channels C4, which have a depth substantially greater (i.e., in general) than that of optional reef contour 3 and dissipative beach 13. The at least two integrated diversion channels C4 further comprise an inner side C41 formed by the side 4 of the at least two islands I1 and I2, and an outer side C42 formed by the at least one pool side 8. Diversion channels C4 have a wave entrance C3 disposed in the distal portion DP and facing open to the proximal portion PP, and a wave discharge C5 disposed in the proximal portion PP and facing open to the distal portion DP. The pool sides 8 at the diversion channels C4 form outer sides that are substantially non-dissipative. Islands I1 and I2 may have sides that are dissipative (i.e., turning contact waves toward entry channel C3 and along diversion channel C4) or non-dissipative (i.e., preserving energy.)

Figure 2:
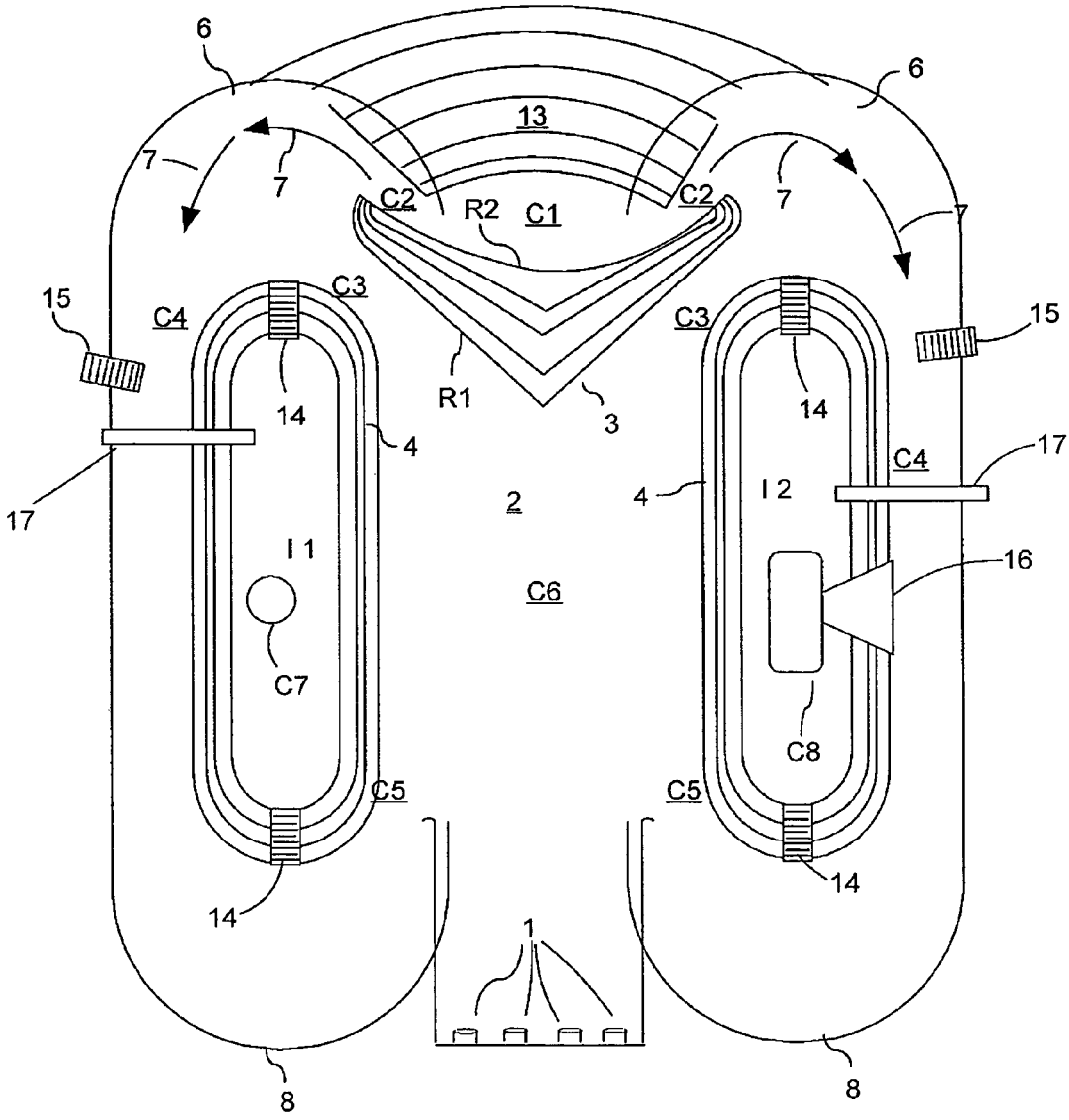
FIG. 2 is a top view of an embodiment of the present invention with optional details.
Figure 3:
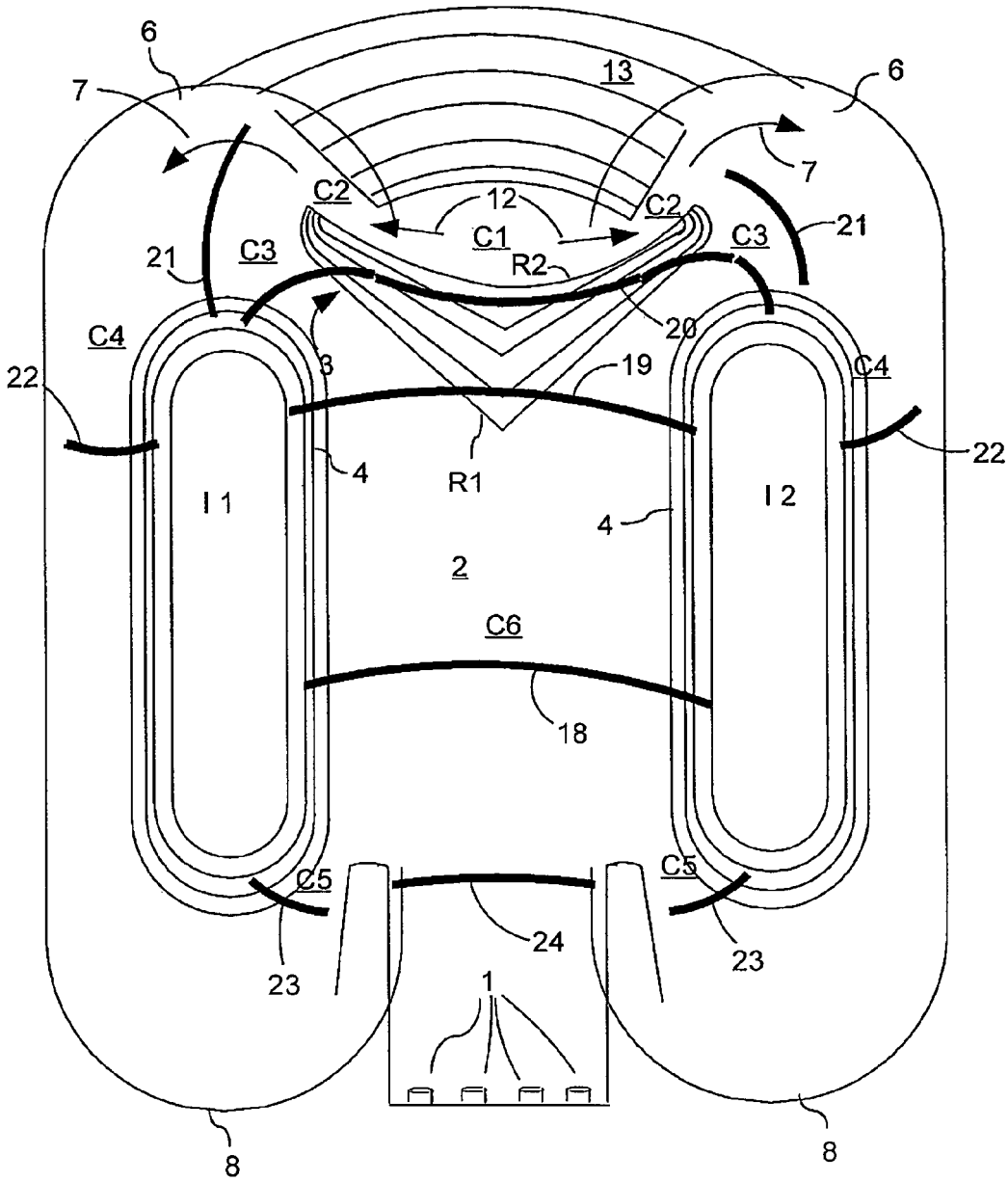
FIG. 3 is a top view of an embodiment of the present invention showing certain wave action.

As may be seen most succinctly in FIGS. 1-3, for embodiments in which a wave travels down a substantially linear wave generating zone C6, diversion channels C4 may be somewhat C-shaped. C-shaped means that the configuration of diversion channels C4 turns a captured high energy portion of a wave around so that the discharge flows in the direction of the original wave. With inlet channels C3 facing open to a proximal portion PP, then the discharge at wave enhancement channel C5 faces a distal portion DP. In this way, inlet channels C3 are primarily for capturing a portion of the wave and enhancement channels C5 are primarily for discharge. At least a portion of inner side C41 and outer side C42 are curved in the longitudinal direction to achieve this configuration.

If a design had both inlet channel C3 and wave enhancement channel C5 facing in substantially the same direction (e.g., both facing open to a proximal portion PP), then any reinforcing or enhancement flow would be weak or non existent. This is because inlet channel C3 and enhancement channel C5 would function similarly with respect to a given wave. That is, if both inlet channel C3 and wave enhancement channel C5 faced open to a proximal portion PP and towards an oncoming wave, they will each capture a portion of the wave flowing into diversion channel C4. The two captured portions of the wave will meet at some point along diversion channel C4 in what is sometimes referred to as a "trapped wave." Energy will be lost as the two portions meet in an increase of amplitude or combined swell. The remainder will flow back out channel C4 in two separate portions, each weaker in reverse than the original. Thus, such a configuration would discharge only relatively "low energy" portions of a wave. Of course, the closer in wave cycle/time that portions of a wave might enter the two ends of diversion channel C4, the closer to the center of diversion channel C4 will the trapped wave portions peak.

Optional reef contour 3 and the diversion channels C4 are configured such that the portion of wave captured by diversion channels C4 will travel into wave entrance C3 at a depth greater than that of reef contour 3 or dissipative beach 13—preserving kinetic energy. The remaining portion of wave 19 (not shown) will break in a desired manner as it reaches reef contour 3 and/or dissipative beach 13. Optional tidal pool or reservoir C1 connects to diversion channels C4 by feed channels C2 which, along with any captured wave, provides a flowing current shown by arrows 7 into diversion channels C4. Wave 19 (not shown) will tend to break because of shallow depths formed by reef contour 3, dumping wash into tidal pool reservoir C1, which is bounded on the other side by dissipative beach 13. Dissipative beach 13 may optionally be kept dry up to a desired point by trapping breaking waves in tidal pool reservoir C1 and, as described above, directing backwash along feed channels C2 into diversion channels C4. On the other hand, some embodiments may lack reef contour 3 and tidal pool C1, such that a portion of waves 19 (not shown) will break on dissipative beach 13, and another portion will enter integrated diversion channels C4 directly.

The word "dissipative" as used herein is intended to describe a sloping surface in which the forward (e.g., from proximal to distal) kinetic energy of a wave is consumed by elevation of water up the surface of a slope. In contrast, a non-dissipative feature is one in which a surface may have a steep slope, such as largely or nearly completely vertical. A non-dissipative feature can redirect wave energy along a given horizontal surface, but does not consume kinetic energy in elevating the amplitude or height of a wave. This is intended to be illustrated by the use of distributed isobaths denoting a slope in, for example, dissipative beach 13. The at least one pool side 8 along diversion channel C4, however, is shown using a single isobath.

Preferably, islands I1 and I2, integrated diversion channels C4, optional contour reef 3 and reservoir C1, etc., are all configured so as to capture a large portion of the volume of water displaced by generated waves within diversion channels C4. The large volume and captured kinetic energy characterized by currents and waves within diversion channel C4 preferably flow in the direction of arrows 7. A large volumetric flow and kinetic energy in diversion channel C4 may thus create an "action river" for enjoyment by swimmers and surfers, as opposed to a lazy river. Further, diversion channels C4 and configuration of islands I1 and I2 within wave pool 2 are preferably symmetric or otherwise balanced in volumetric flow along channels C4 so as to discharge substantially equivalent volume and kinetic energy from wave enhancement channel C5 into both sides of wave generating zone C6.

FIG. 2 is another top view of an embodiment of the present invention showing islands I1 and I2 adapted to support additional activities; for example, optional island bridge 17 may connect islands I1 and I2 to the opposite side of the diversion channels C4. Islands I1 and I2 may include optional graduated island access points 14 permitting those in the water to access islands I1 and I2 and enjoy the island features or simply to relax. Islands I1 and I2 may have optional hot tub C7, optional activity pools C8, and/or optional activity slide 16 for entrance into channel C4. Optional channel access points 15 may provide access to wave pool 2 via diversion channels C4.

The tidal pool reservoir C1, as seen in a third top view in FIG. 3, provides directional current shown by arrows 12 through tidal pool channels C2 into the action river formed in diversion channel C4. The depth of tidal pool reservoir C1 may be less than that in wave generating zone C6, preferably by an elevated bottom (not shown). Channel wall 6 along with islands I1 and I2 is configured to capture and divert wave portion 21 along with tidal reservoir current shown by arrow 12, which creates a strong current in diversion channel C4 as shown by arrows 7 forming an action river. The channel wave 22 travels along diversion channels C4 around islands I1 and I2 and is further diverted by channel wall 8 which forces exiting wave 23 through an optionally narrowing width portion designated as wave enhancement channel C5; exiting wave 23 then travels into wave generating zone C6 to merge with newly formed wave 24 to create integrated wave 18. Wave form 18 travels towards the underwater reef contour leading edge R1 breaking in preferred manner as shown by waves 19 and 20. A portion of wave 20 rolls up and over reef contour trailing edge R2 and washes into tidal pool reservoir C1. The wash is shown discharged by arrows 12 along channel C2 and into the action river of diversion channels C4. Thus, high energy portions of waves 19 and 20 may be captured between reef contour 3 and island sides 4 with controlled depth along entry channels C3, and redirected by side wall 6 and wash current shown by arrows 12 and 7, eventually to form channel waves 22.

For natural and straight coastlines with parallel contours of decreasing depth, refraction decreases the angle between the approaching wave and the coast, which can turn a once obliquely angled wave toward the direction of the coast. In a high volume wave pool, bottom contours may also be used to help create desired breaking along reef contour 3 while feeding high energy wave portions into channels C4. Preferably but not necessarily, reef contour 3 is a modified V shape with gradual inclination from leading edge R1 to a steeper trailing edge R2 in the center of the V, and steeper inclination on wings of the V shape, as shown by the isobaths. The vertex of the V preferably is configured in the direction of the wave generator. As the bottom of pool reservoir 2 transitions from wave generating zone C6 to leading edge R1, the depth becomes increasingly shallow; friction between reef contour and waves 19 and 20 consumes kinetic energy and causes the lower, affected portions of wave 19 to slow, transforming a swell into a tube or curl, and eventually causing waves to break in tidal pool reservoir C1. However, reef contour 3 of the present invention may take a wide variety of configurations, such as curvilinear or angular, so long as the surrounding features of the wave pool, such as islands I1 and I2, beach 13, channel walls 6, and depth along entry channels C3 are coordinated such that channels C4 are integrated into the wave path and high energy portions of waves 19 and 20 are captured by channels C4.

Preferably, islands I1 and I2 are optionally contoured so that a wave traveling longitudinally along wave generating zone C6 or channels C4, such as along wave 19 along island side 4 of islands I1 and I2, will encounter a change in depth that will cause greater friction where the portion of wave 19 approaching islands I1 and I2 will encounter increasingly shallow water as islands I1 and I2 emerge from water within pool reservoir 2. This friction will further turn or redirect a portion of waves 19 and 20 in a direction following channel C4, as shown with waves 21.

Figure 4:
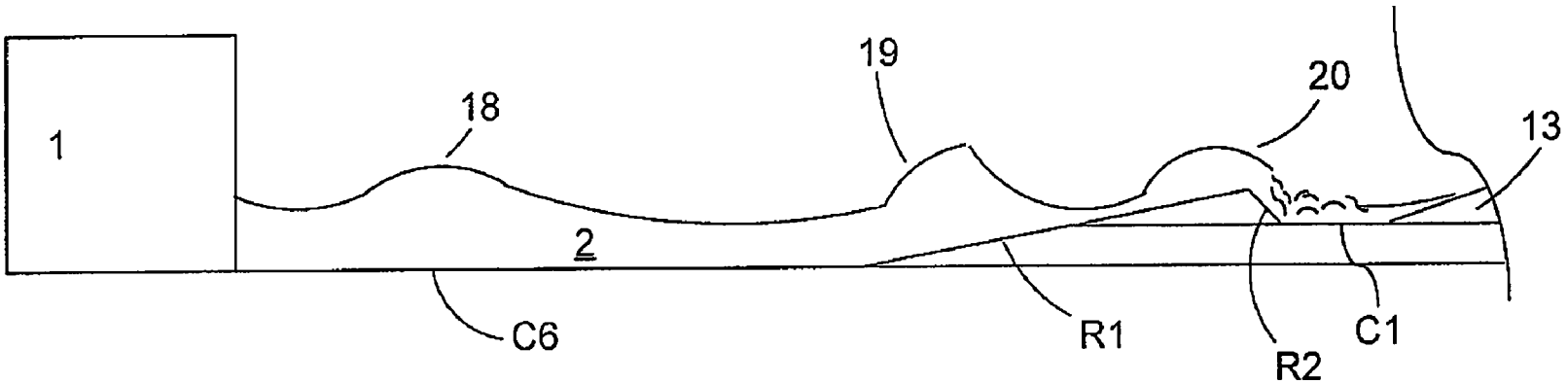
FIG. 4 is a side view of the present invention.

FIG. 4 is a side view plan of one embodiment of the present invention, showing wave 18 reaching contour reef 3 leading edge R1 and breaking wave 19 that will eventually wash past trailing edge R2, similar to wave 20, and into tidal pool reservoir C1. Note that the depth of tidal pool reservoir C1 is less than that of wave generating zone C6.

Figure 5:
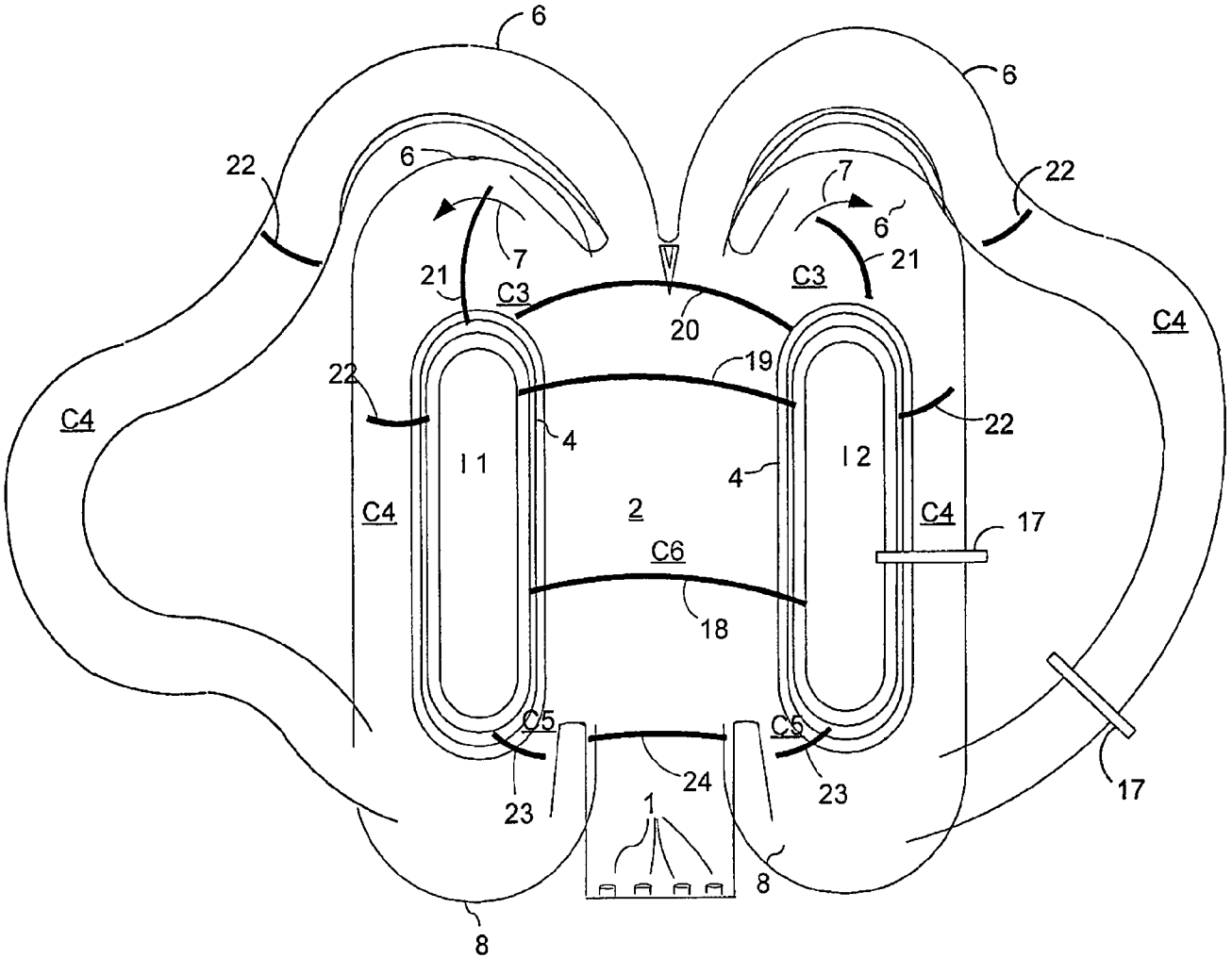
FIG. 5 is an alternative embodiment of the present invention.

FIG. 5 is an alternative embodiment of the present invention having a plurality of channels C4. Channels C4 may be configured to capture varying quantities of wave energy to create action rivers having a variety of levels of current flow, which can satisfy those of differing levels of water skill. Notably, beach 13 may be minimal so long as channels C4 are balanced to supply or discharge into pool 2 evenly or in a balanced manner, and remaining features, such as islands I1 and I2 are properly configured for distribution of wave energy.

Figure 6:
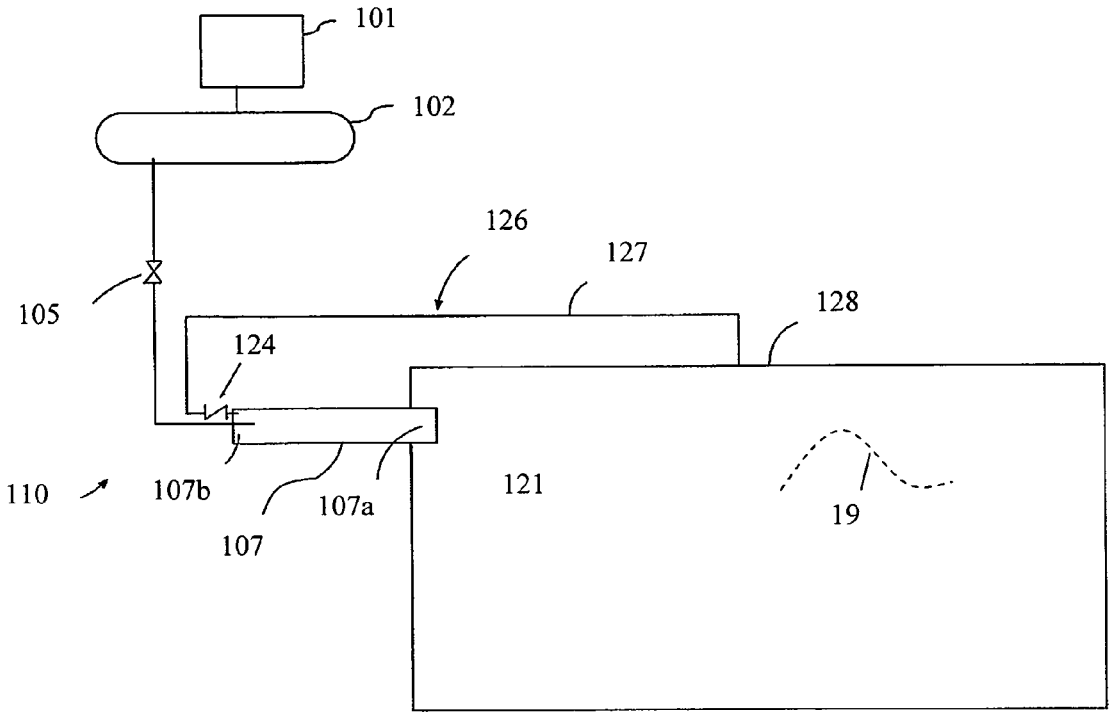
FIG. 6 is a schematic overview of an embodiment of the present invention.

An aspect of an embodiment is that the discharge of wave generators 110 may be controlled or timed. For example, for those embodiments providing wave generator 110. Generation of wave 19 may be controlled to support desired activities. FIG. 6 illustrates wave generator 110, comprising an air compressor 101, a pressurized air storage tank 102 and an air control valve 105 and a control system (not shown) for control of wave generator 110. Wave generator 110 may be controlled manually or automatically. A typical control panel would include a discharge button for manual discharge and various indications, as may be appropriate for the application and a variable pressure adjust for wave generator 110. Variable charging of wave generator 110 enables waves 19 of a variety of size and frequency, so as to match desired conditions. Preferably, control of wave generator 110 may be automated or scripted through a computer processor (not shown) to activate wave generator 110 as well as other features. Because of the scalability of some wave generator(s) 110 the present invention may be employed in a variety of sizes and configurations.

Other devices for the generation of waves may serve in the present invention, depending on the configuration of the facility and the desired effect. Importantly, the wave generation technology should not require structure that could interfere with the activity of the individuals within the body of water 121. In addition, the wave generator 110 should preferably be capable of being scaled to a small or large size, controlled remotely, and recessed so as to present little structural intrusion. In addition, wave generators 110 that are not scalable may be inappropriate for some applications. Therefore, preferably the wave generator 110 will be non-interfering, scalable, remotely controllable, and capable of generating suitable waves.

In one embodiment, the wave generator 110 may be located at the proximal end of the body of water 121. The wave generator(s) 110 may be configured so as to discharge directly into the body of water 121 for generating wave 19. The at least one wave generator 110 may comprise an elongated tubular chamber 107 having a substantially closed rear end 107*b* and a substantially open front end 107*a*. The wave generator 110 may requires an anchor for securing the chamber 107 and maintaining the chamber 107 at a desired orientation with respect to the body of water 121. The anchoring may be coupled to the substantially closed rear end 107*b* of the chamber.

In general, the release of compressed air 102 would discharge or expel water from the chamber 107 to generate an effective wave 19. Specifically, a high pressure bubble is created within a rear end 107*b* of the elongated chamber 107 by the release of the compressed air 102. As the bubble expands, it expels the water within the chamber 107 out the front end 107*a*. A side effect of the bubble expansion is that the pressure of the gas or air bubble declines during expansion. In the production of effective waves 19, water is intended to be expelled completely from the chamber 107. Some portion of the air would escape as large bubbles out the front end 107*a* of the chamber 107 into the body of water 121, while other portions of the air might be dispersed into the body of water 121 in a turbulent mix or froth, eventually reducing the pressure within the chamber 107 as water returns to refill the chamber 107. Thus, it had been contemplated that a water slug driven by a large volume gas bubble formed by the released air would produce the most effective discharge of water.

Compressed air 102 can be costly. However, the release of low quantities of compressed air 102 into the chamber 107 can create adverse effects beyond that of inferior waves. The release of smaller quantities of compressed air 102 into the chamber 107 can form a bubble that begins the expulsion of water, but the bubble can then decay to a low pressure condition within the chamber 107 prior to the full expulsion of water. This low pressure can cause water within the chamber 107 and previously expelled water to reverse direction and re-enter the chamber 107 via the front end 107*a* as the bubble collapses and air is dispersed. The low pressure bubble can collapse violently as higher pressure water strikes the rear end 107*b* of the chamber 107. In some embodiments, a vacuum exceeding 10 bar has been observed. Of course, the resulting impact could damage the chamber 107, requiring both a substantial anchoring of the chamber 107 and the use of heavier materials for fabrication of chamber 107. However, it has been discovered that the reverse in direction of expelled water creates suction into the chamber 107 from the body of water 121, which can also be unsafe for individuals swimming or surfing in the vicinity.

An aspect of the present invention is a system for mitigating this low pressure condition within the chamber 107, while also enabling the discharge of sufficient water from the chamber 107 to generate effective wave motion within the body of water 121. Preferably, this mitigation may be accomplished by the introduction of fluid into the chamber 107 to reduce such a low pressure condition and to prevent, or reduce the effects of, a reverse flow of expelled water. The fluid may be any of a wide variety of liquids, gasses or mixtures thereof, depending upon the application. Preferably the fluid is water and/or air when available, for simplicity of design. Preferably also, the location for the make-up source introduction of fluid is at the substantially closed rear end 107*b* of the chamber 107 for simplicity of design.

FIG. 6 also schematically shows an aspect of the present invention directed to generating waves 19, wherein wave generator 110 is configured with respect to a body of water 121, such as wave pool. The invention further comprises a make-up system 126 directed to mitigating low pressure conditions within chamber 107. A make-up fluid conduit 127, such as a pipe or hose, having make-up water provides a mechanism for water from make-up source 128 of fluid (i.e., in this case body of water) to be introduced into the chamber 107 when the pressure within chamber 107 drops below a desired setting. For example, make-up fluid conduit 126 could connect to body of water 121 at a particular depth, so that the actuation pressure for introduction of make-up fluid might simply be the water pressure for the depth at the point of connection. Thus, the predetermined low pressure may be any pressure in chamber 107 relatively lower than that of the body of water 121 at the depth of connection. Accordingly, in such cases the mass of fluid introduced by make-up fluid conduit 127 would be zero for a pressure in chamber 107 equal to that in the body of water 121 at the connection, and would increase as the relatively low pressure in chamber 107 increases with respect to that at the body of water 121.

This aspect may thus include a wave generator 110 having an elongated chamber 107 oriented such that body of water 121 may fill the chamber 107 via a substantially open front end 107*a*, a supply of compressed air 102 (i.e., supported by air compressor 101) fluidly interconnected with chamber 107. The chamber 107 may be oriented such that the slope between the rear end 107*b* and the front end 107*a* ranges from about 0 to about 5 percent.

The air control valve 105 of the present invention may be in fluid communication with the supply of compressed air 102 for controlling the flow of compressed air into chamber 107. Additionally, the make-up fluid conduit 127 may be fluidly connected to chamber 107, wherein the air control valve 105 can release the compressed air 102 into chamber 107 to expel water within the chamber 107 out of the front end 107*a* and further wherein the make-up fluid conduit 127 can introduce make-up fluid, such as gas, liquid and mixtures thereof, into the chamber 107 to replace at least some of the water expelled out of the front end 107*a*. Optionally, the make-up fluid conduit 127 may be located at the substantially closed rear end 107*b* of the chamber.

When compressed air 102 is released into the chamber 107, pressure within chamber 107 initially increases. Water within chamber 107 is expelled from chamber 107 and into body of water 121 along front end 107*a*. If a low pressure is formed within the chamber 107 during this process (e.g., at substantially closed rear end 017*b*), then water from the make-up fluid conduit 127 would be introduced into the chamber 107 to mitigate or relieve the low pressure condition. A fluid control valve 124, such as a check valve or other actuating control valve (not shown), is preferably inserted into the make-up fluid conduit 127 in order to control the release of fluid into chamber 107. Because make-up fluid conduit 127 is directed to flow into chamber 107, such a fluid control valve 124 may be useful for controlling the release to a desired low pressure level and to prevent back flow from chamber 107 into make-up fluid conduit 127. In an alternative embodiment, such a fluid control valve 124 could be fluidly connected to atmosphere such that atmospheric air could be released into chamber 107 for mitigation of a low pressure condition.

Figure 7:
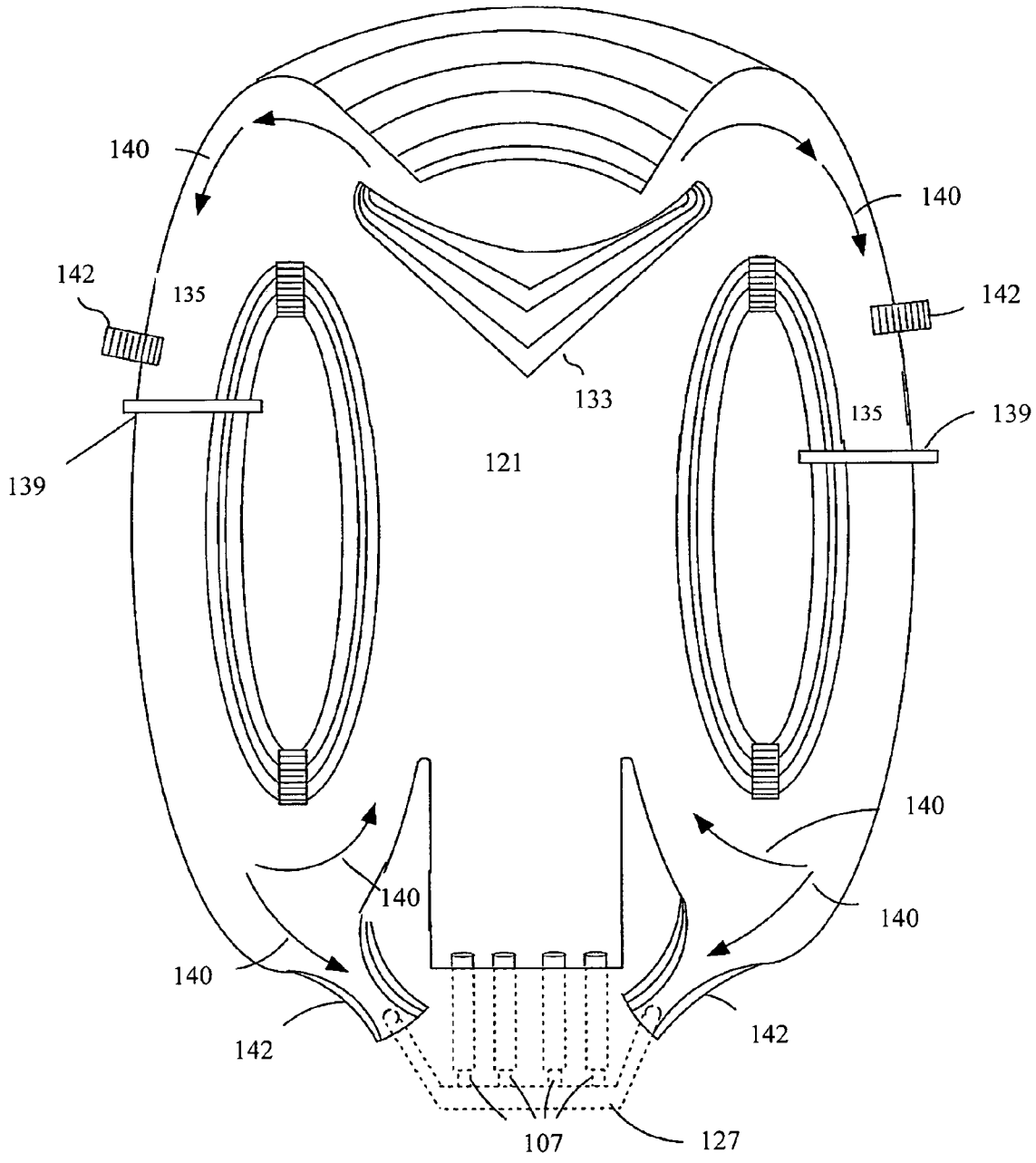
FIG. 7 is a top view of a wave pool embodiment of the present invention.

FIG. 7 shows a related embodiment that illustrates the usefulness of make up for chamber 107 of the wave generator 110, in which body of water 121 is configured as a wave pool. Waves are generated from chamber 107 in the direction of a reef 133. Optionally, the make-up fluid conduit 127 may collect overflow fluid from a drainage system, or other desired make-up source. Additionally, the water feature may comprise a river return 135 or a plurality of river returns within the body of water 121 to collect overflow fluid from a body of water 121. In one embodiment, the make-up fluid conduit 127 may comprise the river return 135 to introduce fluid into chamber 107 to mitigate low pressure conditions. Alternatively, the river return 135 may be formed by integrated islands 137 and reef 133 within wave pool types of body of water 121. For orientation, integrated islands 137 are shown with bridges 139 for access. Directional arrows 140 show current flow; this configuration of body of water 121 and make-up fluid will increase the flow along river returns 135. Surfers may ride river returns 135 to travel from the location in body of water 121 where waves break on reef 133 to the point of wave generation near chamber 107. Personnel access points 112 may be provided at the point where make-up fluid conduit 127 draws from river return 135. A chute may be employed with the present invention within such facilities.

Thus, in summary, an aspect of the present invention is that the volume of compressed air 102 released into the chamber 107 may be reduced, depending on the nature of the application, without causing a violent bubble collapse due to a low pressure condition in the chamber 107. The present invention reduces the consumption of compressed air 102 (or other gas), which also reduces the operating cost. A further aspect of the present invention is that the mitigation of a low pressure condition within the chamber 107 reduces the tendency of the low pressure to place a drag on the water expelled from the chamber 107. Accordingly, the present invention enables a reduction of the compressed air 102 used along with little or no decrease in the ability to expel water, and little or no decrease in the quality or effectiveness of generated waves 19. Further, the invention enables a reduction in the heaviness of materials of construction.

Figure 8:
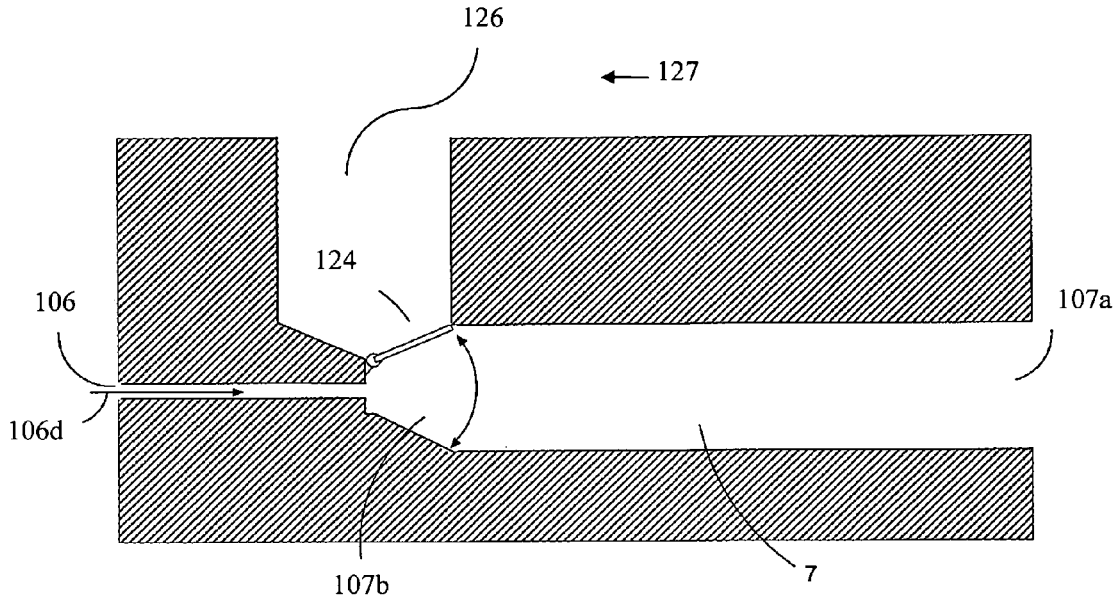
FIG. 8 is a schematic side view of an embodiment of the present invention.

FIG. 8 is a partial schematic of a pump application showing chamber 107. Make-up 126 may collect fluid from the fluid conduit 127. Compressed air 102 may be released along path 106 in fluid connection with chamber 107 in the direction of arrow 106*d*. Compressed air 102 expels water out of the chamber 107 through open front end 107*a*. Optionally, a check valve 124 may be used. Operation of make-up 126 is similar to that of other embodiments. Upon the initial release of compressed air 102 into the chamber 107, a high pressure condition is created and the check valve 124 is closed. If a low pressure condition exists in chamber 107, the check valve 124 is opened permitting water to fill chamber 107. For pumping, make-up 126 may be used for filling chamber 107. If desired, chamber 107 may be filled with water entering through open front end 107*a*. Because the pressure differences have been reduced, refilling will be by very smooth fluid flow.

This arrangement could be modified for use as an in-line flow engine to drive a waterborne vessel, such that the make-up 126 and closed end 107*b* would face forward and open end 107*a* would face aft.

Figure 9:
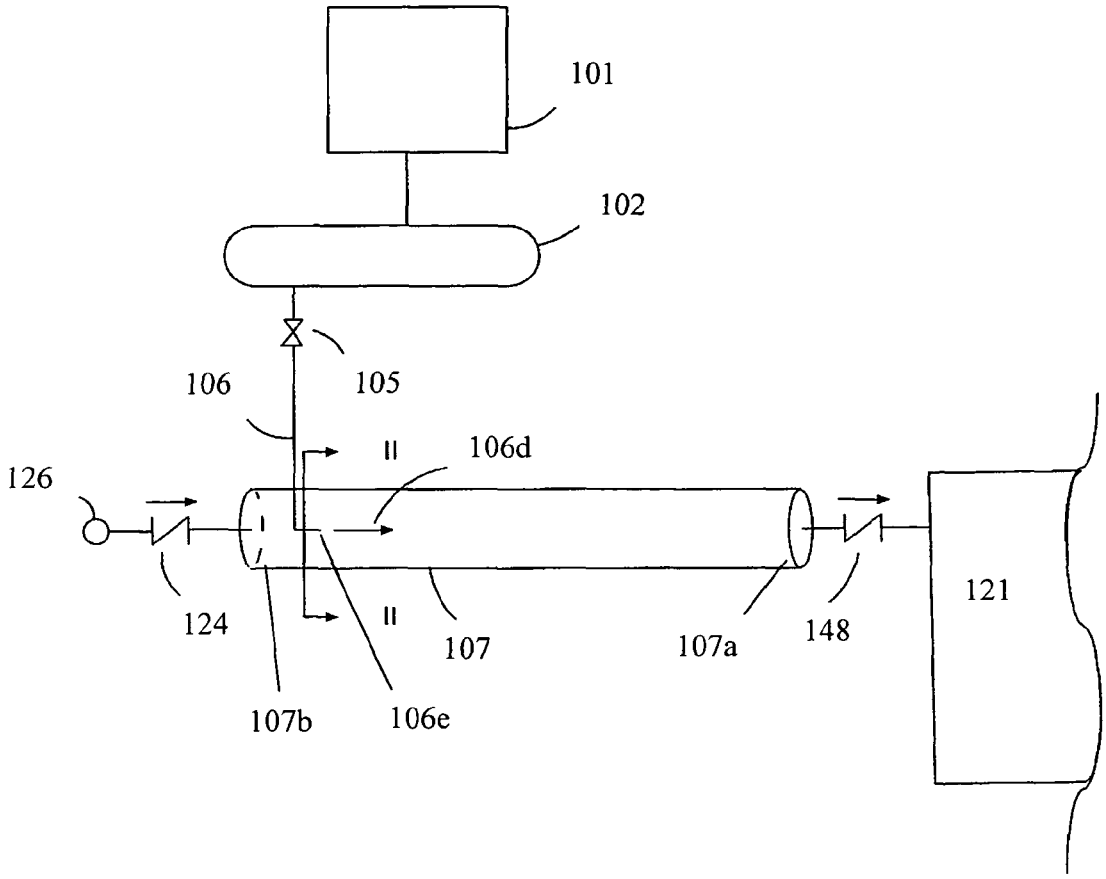
FIG. 9 is a schematic overview of an embodiment of the present invention.

It is contemplated that embodiments of the present invention may improve wave cannons used as volume pumps as shown schematically in FIG. 9. Closed end 107*b* of chamber 107 may mount check valve 124. Check valve 124 may vary in size, even to the point of having the diameter equivalent to chamber 107. Thus, check valve 124 may admit or introduce a release of fluid from make-up 126 into chamber 107 in the event of low pressure. The compressed air 102 release structure 106*e* is shown as a nozzle within chamber 107 and could be configured axially or centrally in-line with the axis of the chamber 107. If the substantially open end 107*a* of chamber 107 is submerged in a body of water 121, it may further be configured with a discharge check valve 148, permitting discharge only and no back flow. This configuration wave generator 110 could be used as a large volume pump fro transferring water from make-up 126 to body of water 121. In such cases, the source of make-up 126 could be a catch basin or drainage collection point, while body of water 121 is a discharge body.

Figure 10:
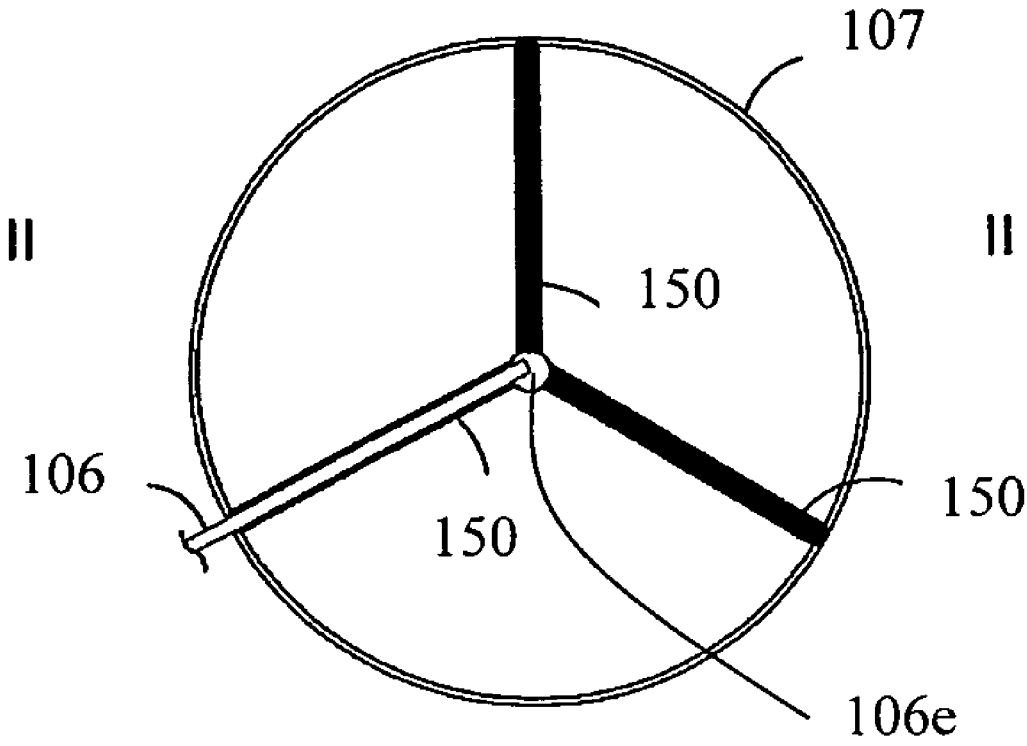
FIG. 10 is an axial cutaway view of a chamber of the present invention.

FIG. 10 is a cross section view of chamber 107 with compressed air 102 paths 106 running to axially mounted release structure 106*e*. Struts 150 may be used to mount release structure 106*e* within the axial orientation.

Figure 11:
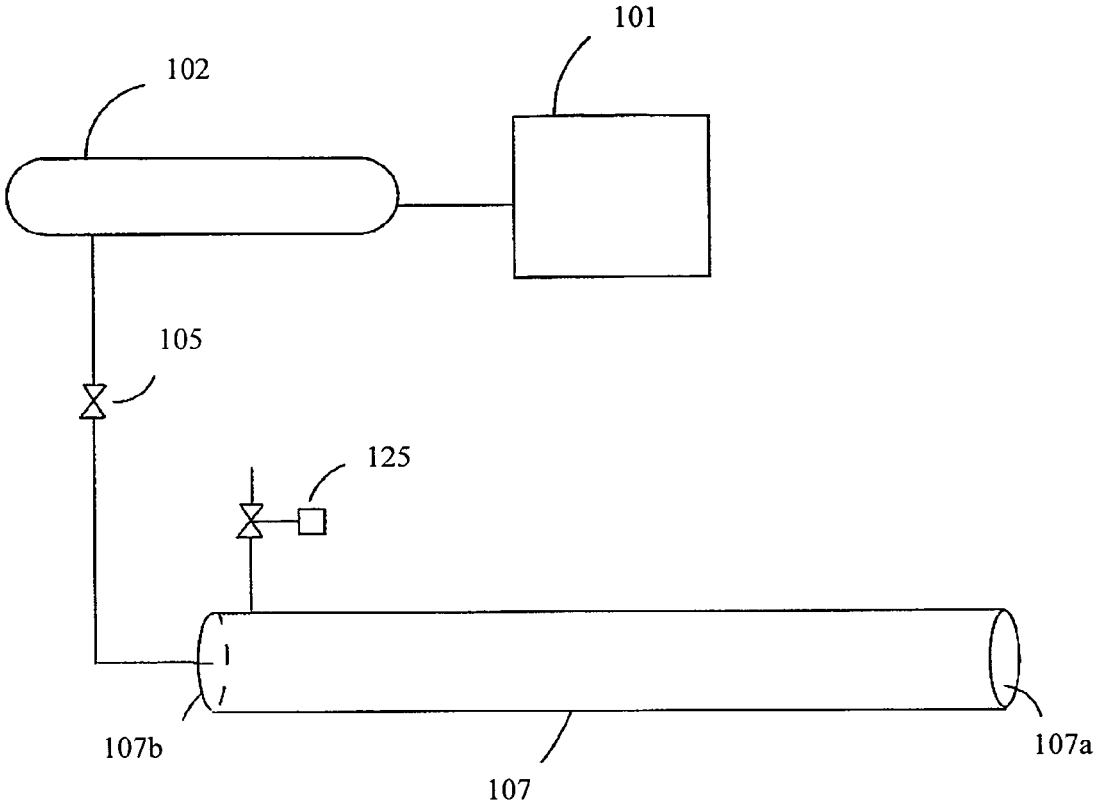
FIG. 11 is an alternate embodiment of the present invention.

FIG. 11 is an example of an alternative embodiment of the present invention wherein make-up 126 draws air from atmosphere into chamber 107 to mitigate a low pressure condition in chamber 107. Make up control valve 125 may operate upon reaching a desired low pressure condition within chamber 107.

The above examples should be considered to be exemplary embodiments, and are in no way limiting of the present invention. Thus, while the description above refers to particular embodiments of the present invention, it will be understood that many modifications may be made without departing from the spirit thereof.

What is claimed is:

1. A wave pool comprising:

a bottom, a first substantially vertical pool side, and a second substantially vertical pool side, the wave pool containing a body of water having proximal and distal portions;

wherein, the bottom and first and second pool sides form a substantially dissipative beach disposed at the distal portion of the body of water;

a wave generator disposed at the proximal portion of the body of water and configured to produce waves in the body of water and configured to produce waves in the body of water that move from the proximal portion to the distal portion;

a reef contour disposed substantially laterally in the bottom intermediate the wave generator and the dissipative beach;

first and second islands disposed in the bottom defining, respectively, first and second integrated diversion channels having a depth substantially greater than that of the reef contour and dissipative beach, wherein each of the first and second integrated diversion channels further comprises an inner side formed by a respective one of said first and second islands, an outer side formed by a respective one of said first and second pool sides, a wave entrance disposed in the distal portion and facing open at least in part to the proximal portion, and a wave discharge disposed in the proximal portion and facing open to the distal portion, the outer sides being substantially non-dissipative, and wherein the reef contour and the diversion channels are configured to capture a high energy portion of the waves within the diversion channel and to redirect the captured portion of the waves from the distal portion of the body of water to the proximal portion of the body of water, with the captured portion of the wave exiting the wave discharge and moving in a proximal to distal direction;

wherein the first and second integrated diversion channels, reef, and first and second islands are configured so as to enable at least one of the first and second integrated diversion channels to capture and maintain a sufficiently high energy portion of the waves so as to move a person from the distal portion of the body of water to the proximal portion of the body of water.

2. The wave pool of claim 1, further comprising a tidal pool disposed intermediate the reef contour and the dissipative beach, and wherein the tidal pool is configured to receive water from the waves and to provide water to the diversion channels so that water moves from the distal portion to the proximal portion of the body of water.

3. The wave pool of claim 1, wherein the diversion channels and wave generator are further configured so as to be adapted to capture a high energy portion of the waves and to redirect the captured portion of the waves from the distal portion of the body of water to the proximal portion of the body of water at substantially the same as the wave generator produces a new wave, so that when the captured portion of the waves is redirected to the proximal portion of the body of water, it reinforces the new wave.

4. The wave pool of claim 1, wherein the distance between the inner side and the outer side of at least one of the first and second integrated diversion channels decreases from the wave entrance to the wave discharge.

5. The wave pool of claim 1, wherein at least one of the first and second integrated diversion channels is configured so as to be adapted to capture and maintain a sufficiently high energy portion of the waves so as to support surfing within the at least one of the first and second integrated diversion channels.

6. The wave pool of claim 1, wherein the integrated diversion channels, reef, and islands are configured so as to be adapted to capture and maintain a sufficiently high energy portion of the waves so as to form an action river within at least one of the first and second integrated diversion channels.

7. The wave pool of claim 1, further wherein the wave generator comprises:

an elongated tubular chamber having a substantially closed rear end and a substantially open front end in fluid communication with the body of water;

an anchor for securing the chamber and for maintaining the chamber in a desired orientation with respect to the proximal end of the body of water;

a gas compression compartment in fluid communication with the substantially closed rear end of the chamber;

a gas control valve in fluid communication with the gas compression compartment and the chamber, the gas control valve adapted to operatively control the flow of compressed gas from the gas compression compartment to the chamber;

a supply of make-up fluid;

a make-up fluid conduit in fluid communication with the chamber and the supply of make-up fluid; and wherein actuation of the gas control vale is capable of causing compressed gas to be released into the rear end of the chamber to forcibly expel fluid within the chamber out of the open front end into the body of water; and wherein the make-up fluid is adapted to introduce fluid into the rear end of the chamber to relieve low pressure in the chamber.

8. The wave pool of claim 7, wherein the make-up fluid supply is the body of water.

9. The wave pool of claim 1, wherein the reef contour defines a substantially lateral V shape having a vertex oriented generally toward the wave generator and configured to direct waves into the side channels.

10. A method comprising:

providing a pool having a bottom, a first substantially vertical pool side, and a second substantially vertical pool side, the pool containing a body of water having a proximal portion and a distal portion, wherein the bottom and first and second pool sides form a substantially dissipative beach disposed at the distal portion of the body of water;

producing waves that move from the proximal portion to the distal portion of the body of water;

communicating the waves to the substantially dissipative beach disposed near the distal portion of the body of water;

breaking a portion of the waves on a reef contour disposed substantially laterally in the bottom, intermediate the wave generator and the substantially dissipative beach, the reef contour defining a V with the vertex thereof oriented generally toward the wave generator; and providing first and second islands defining, respectively, first and second integrated diversion paths at a depth substantially greater than that of the reef contour and dissipative beach, wherein each of the first and second integrated diversion paths further includes an inner side formed by a respective one of said first and second islands, an outer side formed by a respective one of said first and second pool sides, a wave entrance disposed in the distal portion and facing open to the proximal portion, and a wave discharge disposed in the proximal portion and facing open to the distal portion, the outer side being non-dissipative, and wherein the beach and the reef contour are configured to direct water from the breaking waves into the diversion paths, and further wherein the integrated diversion paths are configured to capture a high energy portion of the waves and to return the water and high energy portion of the waves from the distal portion of the body of water to the proximal portion thereof;

wherein the first and second integrated diversion channels, reef, and first and second islands are configured so as to enable at least one of the first and second integrated diversion channels to capture and maintain a sufficiently high energy portion of the waves so as to move a person from the distal portion of the body of water to the proximal portion of the body of water.

11. The method of claim 10, wherein the pool further comprises a tidal pool disposed intermediate the reef contour and the dissipative beach, and wherein the tidal pool is configured to receive water from the waves and to provide water to the diversion channels so that water moves from the distal portion to the proximal portion of the body of water.

12. The method of claim 10, wherein the diversion channels and wave generator are further configured so as to be adapted to capture a high energy portion of the waves and to redirect the captured portion of the waves from the distal portion of the body of water at substantially the same time as the wave generator produces a new wave, so that when the captured portion of the waves is redirected to the proximal portion of the body of water, it reinforces the new wave.

13. The method of claim 10, wherein the distance between the inner side and the outer side of at least one of the first and second integrated diversion channels decreases from the wave entrance to the wave discharge.

14. The method of claim 10, wherein at least one of the first and second integrated diversion channels is configured so as to be adapted to capture and maintain a sufficiently high energy portion of the waves so as to support surfing within the at least one of the first and second integrated diversion channels.

15. The method of claim 10, wherein the first and second integrated diversion channels, reef, and islands are configured so as to be adapted to capture and maintain a sufficiently high so as to be adapted to capture and maintain a sufficiently high energy portion of the waves so as to form an action river within at least one of the first and second integrated diversion channels.

16. The method of claim 10, further wherein the wave generator comprises:

an elongated tubular chamber having a substantially closed rear end and a substantially open front end in fluid communication with the body of water;

an anchor for securing the chamber and for maintaining the chamber in a desired orientation with respect to the proximal end of the body of water;

a gas compression compartment in fluid communication with the substantially closed rear end of the chamber;

a gas control valve in fluid communication with the gas compression compartment and the chamber, the gas control valve adapted to operatively control the flow of compressed gas from the gas compression compartment to the chamber;

a supply of make-up fluid;

a make-up fluid conduit in fluid communication with the chamber and the supply of make-up fluid; and wherein actuation of the gas control valve is capable of causing compressed gas to be released into the rear end of the chamber to forcibly expel fluid within the chamber out of the open front end into the body of water; and wherein the make-up fluid conduit is adapted to introduce fluid into the rear end of the chamber to relieve low pressure in the chamber.

17. The method of claim 16, wherein the makeup fluid supply is the body of water.

18. The method of claim 10, where the reef contour defines a substantially lateral V shape having a vertex oriented generally toward the wave generator.

* * * * *